US009272395B2

(12) United States Patent
Hui

(10) Patent No.: US 9,272,395 B2
(45) Date of Patent: Mar. 1, 2016

(54) MULTIPLE-IN-ONE SOCKET

(71) Applicant: David Hui, Taipei (TW)

(72) Inventor: David Hui, Taipei (TW)

( * ) Notice: Subject to any disclaimer, the term of this patent is extended or adjusted under 35 U.S.C. 154(b) by 235 days.

(21) Appl. No.: 14/049,215

(22) Filed: Oct. 9, 2013

(65) Prior Publication Data

US 2014/0251091 A1 Sep. 11, 2014

(30) Foreign Application Priority Data

Mar. 7, 2013 (TW) ..... 102204187 U

(51) Int. Cl.
*B25B 13/06* (2006.01)

(52) U.S. Cl.
CPC ..... *B25B 13/065* (2013.01)

(58) Field of Classification Search
CPC ..... B25B 13/02; B25B 13/065
USPC ..... 81/124.4
See application file for complete search history.

(56) References Cited

U.S. PATENT DOCUMENTS

| | | | | |
|---|---|---|---|---|
| 1,478,736 | A * | 12/1923 | Gadberry | 81/124.4 |
| 5,048,379 | A * | 9/1991 | Gramera et al. | 81/124.4 |
| 6,269,717 | B1 * | 8/2001 | Bollinger | 81/177.2 |
| 7,334,506 | B2 * | 2/2008 | Hui | 81/124.4 |
| 7,434,494 | B1 * | 10/2008 | Snider | 81/177.1 |
| 2008/0121073 | A1 * | 5/2008 | Williams | 81/121.1 |
| 2014/0013905 | A1 * | 1/2014 | Li | 81/124.4 |

* cited by examiner

*Primary Examiner* — David B Thomas

(57) ABSTRACT

A multiple-in-one socket includes a socket body having a first gradational cavity recessed in a first end of the socket body, and a second gradational cavity recessed in a second end of the socket body opposite to the first gradational cavity; each gradational cavity including a plurality of polygonal holes gradationally contracted in sizes inwardly from an outermost hole towards an innermost hole; whereby a plurality of polygonal holes having plurality of hole sizes may be conveniently chosen for fastening a bolt or nut by correspondingly matching the bolt (or nut) size with the polygonal-hole size.

2 Claims, 1 Drawing Sheet

MULTIPLE-IN-ONE SOCKET

BACKGROUND OF THE INVENTION

U.S. Pat. No. 4,840,094 disclosed a multiple socket device having four different socket sizes located about a single axis comprising a first (outer) member and a second (inner) member. The first member (5) has a first inside diameter (11) corresponding to the largest of four different socket sizes, and a second inside diameter (13) corresponding to the second largest of the four different socket sizes. The second member (25) has a third inside diameter (35) corresponding to the second smallest of the four different socket sizes, and a fourth diameter (43) corresponding to the smallest of the four different socket sizes. The second member (25) is designed to be slidably mounted within the first member (5) along the single axis (3).

If it is intended to use the first or second inside diameter (11 or 13), the second member (25) must be slidably removed from the first member (5) in order for driving an object (such as a screw) adapted to be inserted into the socket corresponding to the diameter 11 or 13. It is quite inconvenient for slidably removing the second member from the first member.

Still, if for using the third or fourth diameter (35 or 43), the second member (25) should then be slidably fixed into the first member (5), causing very inconvenient operation.

The present inventor has found the drawbacks of the prior art and invented the multiple-in-one socket in accordance with the present invention.

SUMMARY OF THE INVENTION

The object of the present invention is to provide a multiple-in-one socket including a socket body having a first gradational cavity recessed in a first end of the socket body, and a second gradational cavity recessed in a second end of the socket body opposite to the first gradational cavity; each gradational cavity including a plurality of polygonal holes gradationally contracted in sizes inwardly from an outermost hole towards an innermost hole; and an outermost hole of the second gradational cavity being smaller in size than an innermost hole of the first gradational cavity; whereby a plurality of polygonal holes having plurality of hole sizes may be conveniently chosen for fastening a bolt or nut by correspondingly matching the bolt (or nut) size with the polygonal-hole size.

DETAILED DESCRIPTION

Figure 1:
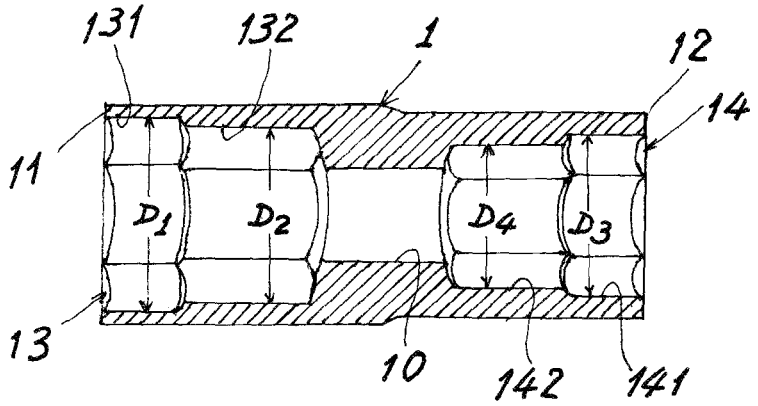
FIG. 1 is a longitudinal sectional drawing of the present invention.

As shown in the drawing figures, the present invention comprises: a socket body 1, a first gradational cavity 13 recessed in a first end 11 of the socket body 1, a second gradational cavity 14 recessed in a second end 12 of the socket body 1 opposite to the first gradational cavity 13, and an intermediate hole 10 formed through the socket body 1 and formed in between the first gradational cavity 13 and the second gradational cavity 14.

Figure 2:
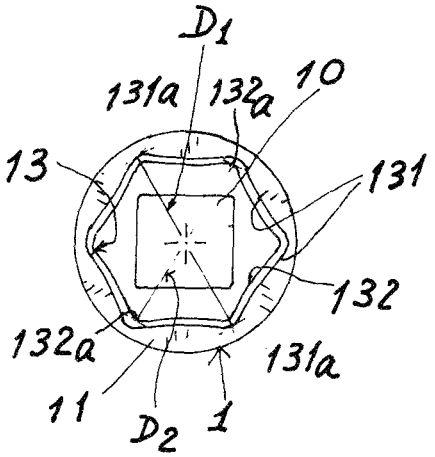
FIG. 2 is a left-side view of the present invention as viewed from a left end of the socket of FIG. 1.

The first gradational cavity 13 includes a plurality of polygonal holes gradationally contracted in sizes inwardly from an outermost polygonal hole 131 towards an innermost polygonal hole 132. For instance, the outermost polygonal hole 131 may be a hexagonal hole having a first diagonal distance D1 defined between two opposite apices 131*a* of the hexagonal outermost hole 131 as shown in FIG. 2 and FIG. 1. The innermost polygonal hole 132 may also be a hexagonal hole having a second diagonal distance D2 defined between two opposite apices 132*a* of the hexagonal innermost hole 132. The first diagonal distance D1 of the outermost hole 131 is larger than the second diagonal distance D2 of the innermost hole 132, indicating that the outermost hole 131 is gradationally contracted in size inwardly towards the innermost hole 132.

Figure 3:
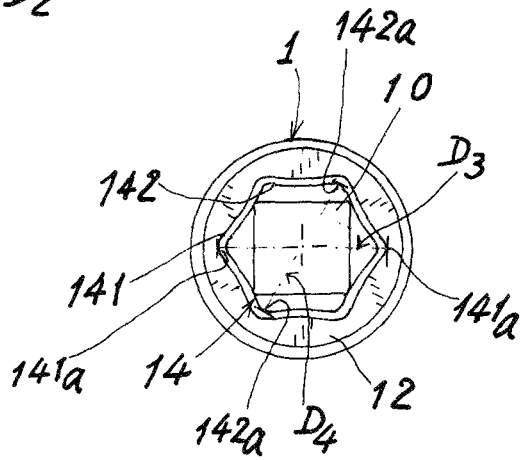
FIG. 3 is a right-side view of the present invention as viewed from a right end of the socket of FIG. 1.

The second gradational cavity 14 includes a plurality of polygonal holes gradationally contracted in sizes inwardly from an outermost polygonal hole 141 towards an innermost polygonal hole 142. For instance, the outermost polygonal hole 141 may be a hexagonal hole having a third diagonal distance D3 defined between two opposite apices 141*a* of the hexagonal outermost hole 141 as shown in FIG. 3 and FIG. 1. The innermost polygonal hole 142 may also be a hexagonal hole having a fourth diagonal distance D4 defined between two opposite apices 142*a* of the hexagonal, innermost hole 142. The third diagonal distance D3 of the outermost polygonal hole 141 is larger than the fourth diagonal distance D4 of the innermost hole 142, indicating that the innermost hole 142 is gradationally contracted in size inwardly from the outermost hole 141.

By sequentially arranging the four polygonal holes 131, 132, 141, 142, and by comparing their sizes, a relationship is obtained as follows:

$$D1>D2>D3>D4,$$

indicating that the hole sizes of the four holes 131, 132, 141, 142 are gradationally or gradually contracted or reduced.

The above-mentioned hole sizes are each defined as a diagonal distance D1~D4 as measured between every two opposite apices of each diagonal line of each hexagonal hole 131, 132, 141, 142.

Other definitions such as inside diameters, may also be designated, not limited, in the present invention.

The number of the polygonal holes are not limited in the present invention. For instance, either the first gradational cavity 13 or the second gradational cavity 14 may be modified to be a first cavity or a second cavity, having only one single polygonal or hexagonal hole in one cavity.

A driving head or rod of a wrench (not shown) may be inserted into the intermediate hole 10 (which may be a square hole) for rotatably driving the socket body 1 for fastening or unfastening a bolt or nut as engaged in a corresponding hole among the holes 131, 132, 141, 142.

The present invention may have the following advantages superior to a conventional socket:

1. Just as the title of the present invention saying "multiple-in-one", one socket is enough, which include a plurality of (or four) polygonal holes, thereby providing plural (or four) choices or selections for operating plural (or four) bolts or nuts just by preparing one socket only, rather than plural (or four) sockets for convenient selection, use, operation, handling, and storage.
2. There is no need to slidably fix (or remove) an inner member into (or from) an outer member for variating the socket sizes as found in U.S. Pat. No. 4,840,094.

3. The cost for tool management, equipment installation, and inventory control may be greatly reduced, thereby increasing the economic value in related industrial or commercial fields.

The present invention may be modified without departing from the spirit and scope of the present invention.

The present invention may be modified for each hexagonal hole 131, 132, 141, 142 as follows:

Each hexagonal side of the hexagonal hole is "divided" into three "sub-sides", namely, one intermediate sub-side and two inclined sub-sides formed on opposite ends of the intermediate sub-side, so that each hexagonal side has three "faces" and the hexagonal hole, having six sides, will have 18 "faces" totally.

Such a modification was disclosed in the applicant's previous invention, as shown in FIGS. 7 and 8 of U.S. Pat. No. 8,505,417.

I claim:

1. A socket comprising: a socket body, a first gradational cavity recessed in situ in a first end of the socket body, a second gradational cavity recessed in situ in a second end of the socket body opposite to the first gradational cavity, and an intermediate hole formed through the socket body and formed in between the first gradational cavity and the second gradational cavity adapted for inserting a driving rod into said intermediate hole for rotatably driving said socket body;

each said gradational cavity including a plurality of polygonal holes gradationally contracted in sizes inwardly from an outermost polygonal hole towards an innermost polygonal hole in each said gradational cavity; and an innermost polygonal hole of said first gradational cavity being larger in size than an outermost polygonal hole of said second gradational cavity.

2. A socket according to claim 1, wherein said polygonal hole is a hexagonal hole; and the size of each said hexagonal hole is a diagonal distance as defined between opposite apices of each diagonal line of each said hexagonal hole.

* * * * *